US009670944B2

(12) United States Patent
Vigholm et al.

(10) Patent No.: US 9,670,944 B2
(45) Date of Patent: Jun. 6, 2017

(54) METHOD FOR CONTROLLING A HYDRAULIC CYLINDER IN A WORK MACHINE AND CONTROL SYSTEM FOR A WORK MACHINE

(75) Inventors: Bo Vigholm, Stora Sundby (SE); Markku Palo, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 796 days.

(21) Appl. No.: 12/097,916

(22) PCT Filed: Jan. 16, 2007

(86) PCT No.: PCT/SE2007/000031

§ 371 (c)(1),
(2), (4) Date: Jun. 18, 2008

(87) PCT Pub. No.: WO2007/081276

PCT Pub. Date: Jul. 19, 2007

(65) Prior Publication Data

US 2008/0294316 A1 Nov. 27, 2008

Related U.S. Application Data

(60) Provisional application No. 60/759,996, filed on Jan. 18, 2006.

(30) Foreign Application Priority Data

Jan. 16, 2006 (SE) ..... 0600087

(51) Int. Cl.
*F15B 21/00* (2006.01)
*F15B 21/14* (2006.01)
(Continued)

(52) U.S. Cl.
CPC ..... *F15B 21/14* (2013.01); *E02F 9/2095* (2013.01); *E02F 9/2207* (2013.01);
(Continued)

(58) Field of Classification Search
CPC ..... E02F 9/2228; F15B 2211/20515; F15B 11/0406; F15B 2211/851
(Continued)

(56) References Cited

U.S. PATENT DOCUMENTS 4,046,270 A 9/1977 Baron et al.
4,118,149 A 10/1978 Hagberg
(Continued)

FOREIGN PATENT DOCUMENTS

EP 1 571 352 A1 9/2005
JP 2003 120616 A 4/2003
(Continued)

OTHER PUBLICATIONS

International Search Report from corresponding International Application No. PCT/SE2007/000031.
(Continued)

*Primary Examiner* — Thomas B Will
*Assistant Examiner* — Joel F. Mitchell
(74) *Attorney, Agent, or Firm* — WRB-IP LLP

(57) ABSTRACT

A method is provided for controlling a hydraulic cylinder in a work machine, which hydraulic cylinder is arranged to move an implement that is subjected to a load, with the hydraulic cylinder being controlled by a hydraulic machine. The method includes detecting that a lifting movement of the implement is to be initiated, and attaining a basic speed of the hydraulic machine before lifting takes place.

8 Claims, 4 Drawing Sheets

(51) Int. Cl.

| | |
|---|---|
| ***E02F 9/22*** | (2006.01) |
| ***F03C 1/00*** | (2006.01) |
| ***F04B 17/03*** | (2006.01) |
| ***F15B 11/04*** | (2006.01) |
| ***E02F 9/20*** | (2006.01) |
| ***E02F 9/26*** | (2006.01) |

(52) U.S. Cl.
CPC ..... *E02F 9/2217* (2013.01); *E02F 9/2289* (2013.01); *E02F 9/2292* (2013.01); *E02F 9/2296* (2013.01); *E02F 9/265* (2013.01); *F03C 1/00* (2013.01); *F04B 17/03* (2013.01); *F15B 11/0406* (2013.01); *F15B 2211/20515* (2013.01); *F15B 2211/20561* (2013.01); *F15B 2211/20569* (2013.01); *F15B 2211/27* (2013.01); *F15B 2211/3057* (2013.01); *F15B 2211/50518* (2013.01); *F15B 2211/6313* (2013.01); *F15B 2211/6336* (2013.01); *F15B 2211/7053* (2013.01); *F15B 2211/851* (2013.01); *F15B 2211/88* (2013.01); *Y10T 137/8593* (2015.04)

(58) Field of Classification Search
USPC ..... 701/50
See application file for complete search history.

(56) References Cited

U.S. PATENT DOCUMENTS

| | | | | |
|---|---|---|---|---|
| 4,505,111 | A * | 3/1985 | Okamoto et al. | 60/431 |
| 4,723,409 | A * | 2/1988 | Kuhn | 60/422 |
| 5,116,187 | A * | 5/1992 | Fukuda et al. | 414/699 |
| 5,179,836 | A * | 1/1993 | Dantlgraber | 60/430 |
| 5,361,211 | A * | 11/1994 | Lee | E02F 9/123 340/679 |
| 5,537,818 | A * | 7/1996 | Hosseini et al. | 60/327 |
| 5,538,084 | A * | 7/1996 | Nakayama et al. | 172/4.5 |
| 5,862,663 | A * | 1/1999 | Lanza et al. | 60/432 |
| 6,173,572 | B1 * | 1/2001 | Cobo | E02F 9/2203 60/327 |
| 6,691,603 | B2 * | 2/2004 | Linerode | E02F 9/2025 91/433 |
| 6,708,787 | B2 * | 3/2004 | Naruse et al. | 180/53.8 |
| 6,988,363 | B2 * | 1/2006 | Bitter | 60/468 |
| 7,089,733 | B1 | 8/2006 | Jackson et al. | |
| 7,197,871 | B2 * | 4/2007 | Yoshino | 60/414 |
| 7,325,398 | B2 * | 2/2008 | Cherney | 60/476 |
| 7,444,808 | B2 * | 11/2008 | Segerljung | 60/414 |
| 8,407,994 | B2 * | 4/2013 | Kamoshida et al. | 60/431 |
| 2002/0125052 | A1 | 9/2002 | Naruse et al. | |
| 2005/0066655 | A1 | 3/2005 | Aarestad | |
| 2005/0103006 | A1 | 5/2005 | Yoshino | |
| 2007/0166168 | A1 * | 7/2007 | Vigholm et al. | 417/20 |

FOREIGN PATENT DOCUMENTS

| | | |
|---|---|---|
| WO | 2006/107242 A1 | 10/2006 |
| WO | 2006/132031 A1 | 12/2006 |

OTHER PUBLICATIONS

Supplementary European Search Report for corresponding European App. EP07701116.
European Communication Under Rule 71(3) EPC (see p. 5) (Nov. 14, 2014) for corresponding European App. EP07701116.

* cited by examiner

METHOD FOR CONTROLLING A HYDRAULIC CYLINDER IN A WORK MACHINE AND CONTROL SYSTEM FOR A WORK MACHINE

BACKGROUND AND SUMMARY

The present invention relates to a method for controlling at least one hydraulic cylinder in a work machine and a control system for a work machine.

The invention will be described below in connection with a work machine in the form of a wheel loader. This is a preferred but in no way limiting application of the invention. The invention can also be used for other types of work machines (or work vehicles), such as an excavator loader (backhoe) and excavating machine.

The invention relates, for example, to controlling lifting and/or tilting cylinders for operating an implement.

It is desirable to provide a method for controlling a hydraulic cylinder, preferably for a lift function and/or tilt function, that provides smooth operation.

According to an aspect of the present invention, a method is provided for controlling a hydraulic cylinder in a work machine, which hydraulic cylinder is arranged to move an implement that is subjected to a load, with the hydraulic cylinder being controlled by a hydraulic machine, comprising the steps of detecting that a lifting movement of the implement is to be initiated, and attaining a basic speed of the hydraulic machine before lifting takes place. This control method provides a reduction in the starting friction in a hydraulic machine (pump) at the commencement of a lifting movement.

According to a preferred example, the method comprises the steps of the hydraulic machine attaining the basic speed by draining the port of the hydraulic machine that is connected to the piston side of the hydraulic cylinder and thereby allowing a certain amount of leakage flow from the hydraulic machine at the commencement of the lifting movement. A communication path is preferably established between the port of the hydraulic machine that is connected to the piston side of the hydraulic cylinder and a tank, thereby allowing a certain amount of leakage flow from the hydraulic machine to the tank at the commencement of the lifting movement. It is, however, not necessary to drain the port of the hydraulic machine to the tank. According to an alternative, the port of the hydraulic machine that is connected to the piston side of the hydraulic cylinder can be connected to a second port of the hydraulic machine that forms an inlet to the hydraulic machine.

According to a specific example, the method comprises the steps of achieving said draining by opening a control means on a line that is connected to the port of the hydraulic machine.

It is desirable to achieve a control system, preferably for a lift function and/or tilt function, that provides smooth operation According to an aspect of the present invention, a control system is provided for a work machine comprising a hydraulic machine and at least one hydraulic cylinder, characterized in that a first port of the hydraulic machine is connected to a piston side of the hydraulic cylinder via a first line, and in that a control means is arranged to achieve a draining from the first port of the hydraulic machine in order to allow a certain amount of leakage flow from the hydraulic machine at the commencement of a lifting movement.

Said control means preferably comprises an electrically controlled valve. The valve is preferably continuously variable, but an on/off valve is also possible.

The hydraulic cylinder is preferably adapted to move an implement in order to perform a work function. According to a first example, the hydraulic cylinder comprises a lifting cylinder for moving a load arm which is pivotably connected to a vehicle frame, the implement being arranged on the load arm. According to a second example, the hydraulic cylinder comprises a tilting cylinder for moving the implement which is pivotably connected to the load arm.

Further preferred embodiments and advantages of the invention emerge from the following description.

BRIEF DESCRIPTION OF THE DRAWINGS

The invention will be described in greater detail below with reference to the embodiments shown in the accompanying drawings, in which.

DETAILED DESCRIPTION

Figure 1:
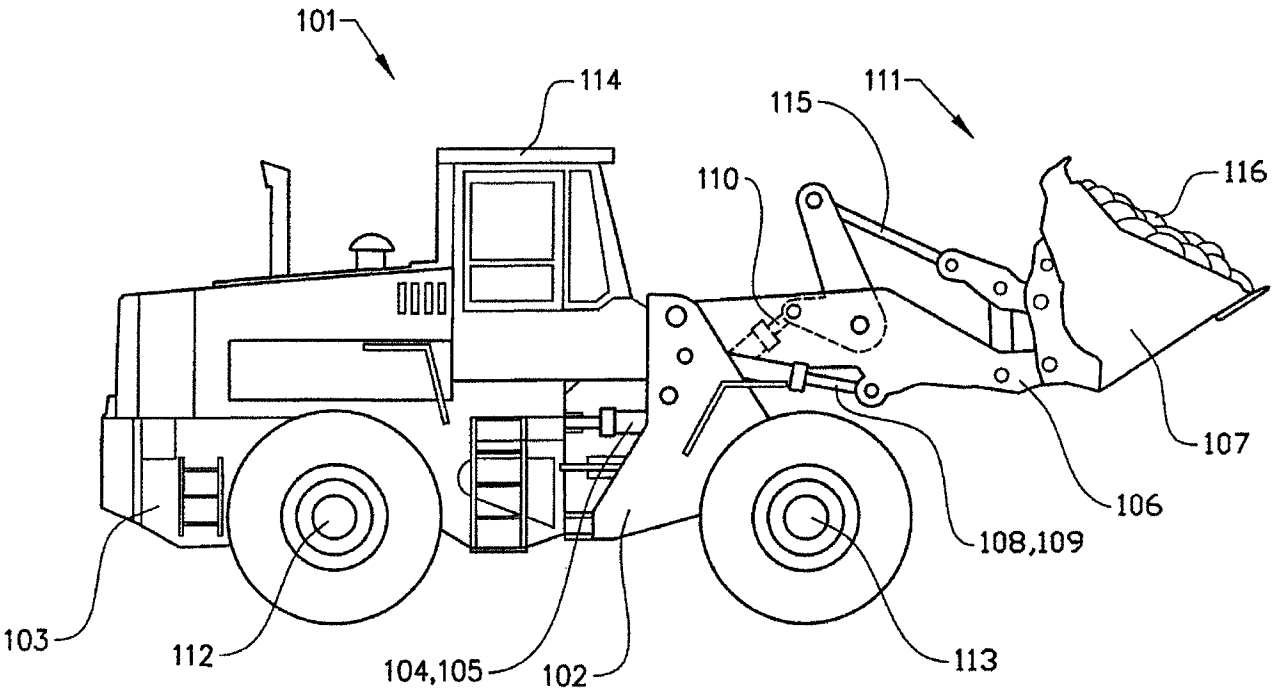
FIG. 1 shows a side view of a wheel loader.

FIG. 1 shows a side view of a wheel loader 101. The wheel loader 101 comprises a front vehicle part 102 and a rear vehicle part 103, which parts each comprise a frame and a pair of drive axles 112, 113. The rear vehicle part 103 comprises a cab 114. The vehicle parts 102, 103 are coupled together with one another in such a way that they can be pivoted in relation to one another about a vertical axis by means of two hydraulic cylinders 104, 105 which are connected to the two parts. The hydraulic cylinders 104, 105 are thus arranged on different sides of a center line in the longitudinal direction of the vehicle for steering, or turning the wheel loader 101.

The wheel loader 101 comprises an apparatus 111 for handling objects or material. The apparatus 111 comprises a lifting arm unit 106 and an implement 107 in the form of a bucket which is mounted on the lifting arm unit. Here, the bucket 107 is filled with material 116. A first end of the lifting arm unit 106 is coupled rotatably to the front vehicle part 102 for bringing about a lifting movement of the bucket. The bucket 107 is coupled rotatably to a second end of the lifting arm unit 106 for bringing about a tilting movement of the bucket.

The lifting arm unit 106 can be raised and lowered in relation to the front part 102 of the vehicle by means of two hydraulic cylinders 108, 109, which are each coupled at one end to the front vehicle part 102 and at the other end to the lifting arm unit 106. The bucket 107 can be tilted in relation to the lifting arm unit 106 by means of a third hydraulic cylinder 110, which is coupled at one end to the front vehicle part 102 and at the other end to the bucket 107 via a link arm system.

An embodiment for raising the lift arm 106 via the lifting cylinders 108, 109 is described below, see FIG. 1. However, the embodiment of the control system should also be able to be used for tilting the bucket 107 via the tilting cylinder 110.

Figure 2:
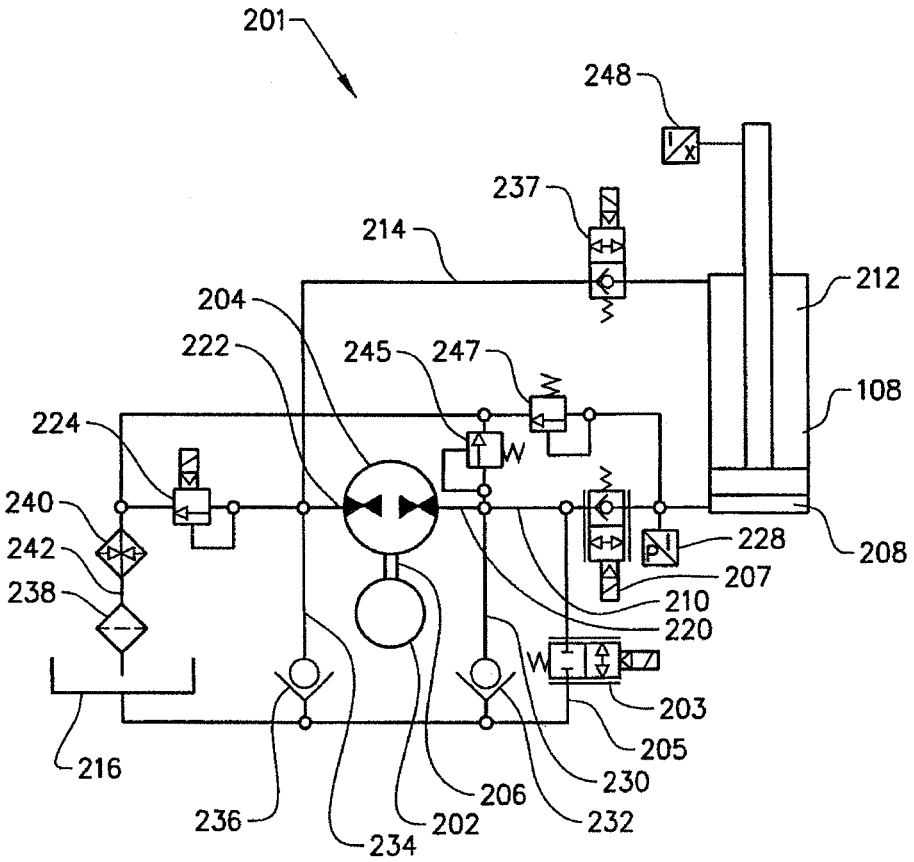
FIG. 2 shows a preferred embodiment of a control system for controlling a work function of the wheel loader.

FIG. 2 shows a first embodiment of a control system 201 for performing lifting and lowering of the lifting arm 106, see FIG. 1. The hydraulic cylinder 108 in FIG. 2 therefore corresponds to the lifting cylinders 108, 109 (although only one cylinder is shown in FIG. 2).

The control system 201 comprises an electric machine 202, a hydraulic machine 204 and the lifting cylinder 108. The electric machine 202 is connected in a mechanically driving manner to the hydraulic machine 204 via an intermediate drive shaft 206. The hydraulic machine 204 is connected to a piston side 208 of the hydraulic cylinder 108 via a first line 210 and a piston-rod side 212 of the hydraulic cylinder 108 via a second line 214.

The hydraulic machine 204 is adapted to function as a pump, be driven by the electric machine 202 and supply the hydraulic cylinder 108 with pressurized hydraulic fluid from a tank 216 in a first operating state and to function as a motor, be driven by a hydraulic fluid flow from the hydraulic cylinder 108 and drive the electric machine 202 in a second operating state.

The hydraulic machine 204 is adapted to control the speed of the piston 218 of the hydraulic cylinder 108 in the first operating state. No control valves are therefore required between the hydraulic machine and the hydraulic cylinder for said control. More precisely, the control system 201 comprises a control unit 402, see FIG. 4, which is electrically connected to the electric machine 202 in order to control the speed of the piston of the hydraulic cylinder 108 in the first operating state by controlling the electric machine.

The hydraulic machine 204 has a first port 220 which is connected to the piston side 208 of the hydraulic cylinder via the first line 210 and a second port 222 which is connected to the piston-rod side 212 of the hydraulic cylinder via the second line 214. The second port 222 of the hydraulic machine 204 is moreover connected to the tank 216 in order to allow the hydraulic machine, in the first operating state, to draw oil from the tank 216 via the second port 222 and supply the oil to the hydraulic cylinder 108 via the first port 220.

The control system 201 comprises a means 224 for controlling pressure, which pressure means 224 is arranged on a line 226 between the second port 222 of the hydraulic machine 204 and the tank 216 in order to allow pressure build-up on the piston-rod side 212. More precisely, the pressure control means 224 comprises an electrically controlled pressure-limiting valve.

The control system 201 also comprises a sensor 228 for sensing pressure on the piston side 208 of the hydraulic cylinder 108.

The first port 220 of the hydraulic machine 204 is connected to the tank 216 via a first suction line 230. A means 232, in the form of a non-return valve, is adapted to allow suction of hydraulic fluid from the tank and obstruction of a hydraulic fluid flow to the tank through the suction line 230.

The second port 222 of the hydraulic machine 204 is connected to the tank 216 via a second suction line 234. A means 236, in the form of a non-return valve, is adapted to allow suction of hydraulic fluid from the tank and obstruction of a hydraulic fluid flow to the tank through the suction line 234.

A means 237 for opening/closing is arranged on the second line 214 between the second port 222 of the hydraulic machine 204 and the piston-rod end 212 of the hydraulic cylinder 108. This means 237 comprises an electrically controlled valve with two positions. In a first position, the line 214 is open for flow in both directions. In a second position, the valve has a nonreturn valve function and allows flow in only the direction toward the hydraulic cylinder 108. During lifting movement, the electric valve 237 is opened and the rotational speed of the electric machine 202 determines the speed of the piston 218 of the hydraulic cylinder 108. Hydraulic fluid is drawn from the tank 216 via the second suction line 234 and is pumped to the piston side 208 of the hydraulic cylinder 108 via the first line 210.

An additional line 242 connects the second port 222 of the hydraulic machine 204 and the tank 216.

A means 243 for opening/closing is arranged on the first line 210 between the first port 220 of the hydraulic machine 204 and the piston end 208 of the hydraulic cylinder 108. This means 243 comprises an electrically controlled valve with two positions. In a first position, the line 210 is open for flow in both directions. In a second position, the valve has a nonreturn valve function and allows flow in only the direction toward the hydraulic cylinder 108.

A sensor 248 is arranged to detect the position of the piston rod.

The electrically controlled valves 237, 243 function as load-holding valves. They are closed in order that electricity is not consumed when there is a hanging load and also in order to prevent dropping when the drive source is switched off. According to an alternative, the valve 237 on the piston-rod side 212 is omitted. However, it is advantageous to retain the valve 237 because external forces can lift the lifting arm 106.

A filtering unit 238 and a heat exchanger 240 are arranged on the additional line 242 between the second port 222 of the hydraulic machine 204 and the tank 216. An additional filtering and heating flow can be obtained by virtue of the hydraulic machine 204 driving a circulation flow from the tank 216 first via the first suction line 230 and then via the additional line 242 when the lifting function is in a neutral position. Before the tank, the hydraulic fluid thus passes through the heat exchanger 240 and the filter unit 238.

There is another possibility for additional heating of the hydraulic fluid by pressurizing the electrically controlled pressure limiter 224 at the same time as pumping-round takes place to the tank in the way mentioned above. This can of course also take place when the lifting function is used.

In addition, the electrically controlled pressure limiter 224 can be used as a back-up valve for refilling the piston-rod side 212 when lowering is carried out. The back pressure can be varied as required and can be kept as low as possible, which saves energy. The hotter the oil, the lower the back pressure can be, and the slower the rate of lowering, the lower the back pressure can be. When there is a filtration flow, the back pressure can be zero.

A first pressure-limiting valve 245 is arranged on a line which connects the first port 220 of the hydraulic machine 204 to the tank 216. A second pressure-limiting valve 247 is arranged on a line which connects the piston side 208 of the hydraulic cylinder 108 to the tank 216. The two pressure-limiting valves 245, 247 are connected to the first line 210 between the hydraulic machine 204 and the piston side 208 of the hydraulic cylinder 108 on different sides of the valve 243. The two pressure-limiting valves 245, 247, which are also referred to as shock valves, are spring-loaded and adjusted to be opened at different pressures. According to an example, the first pressure-limiting valve 245 is adjusted to be opened at 270 bar, and the second pressure-limiting valve 247 is adjusted to be opened at 380 bar.

When the work machine 101 is driven toward a heap of gravel or stones and/or when the implement is lifted/lowered/tilted, the movement of the bucket may be counteracted by an obstacle. The pressure-limiting valves 245, 247 then ensure that the pressure is not built up to levels which are harmful for the system.

According to a first example, the bucket 107 is in a neutral position, that is to say stationary in relation to the frame of the front vehicle part 102. When the wheel loader 101 is driven toward a heap of stones, the second pressure limiter 247 is opened at a pressure of 380 bar.

During ongoing lowering, the valve 243 on the first line 210 between the hydraulic machine 204 and the piston side 208 of the hydraulic cylinder 108 is open. When the lifting arm 106 is lowered, the first pressure limiter 245 is opened at a pressure of 270 bar. If an external force should force the loading arm 106 upward during a lowering operation with power down, the pressure limiter 224 on the line 226 between the second port 222 of the hydraulic machine 204 and the tank 216 is opened.

According to an alternative to the pressure-limiting valves 245, 247 being adjusted to be opened at a predetermined pressure, the pressure-limiting valves can be designed with variable opening pressure. According to a variant, the pressure-limiting valves 245, 247 are electrically controlled. If electric control is used, only one valve 247 is sufficient for the shock function. This valve 247 is controlled depending on whether the valve 243 is open or closed. The opening pressure can be adjusted depending on activated or non-activated lifting/lowering function and also depending on the cylinder position.

Figure 3:
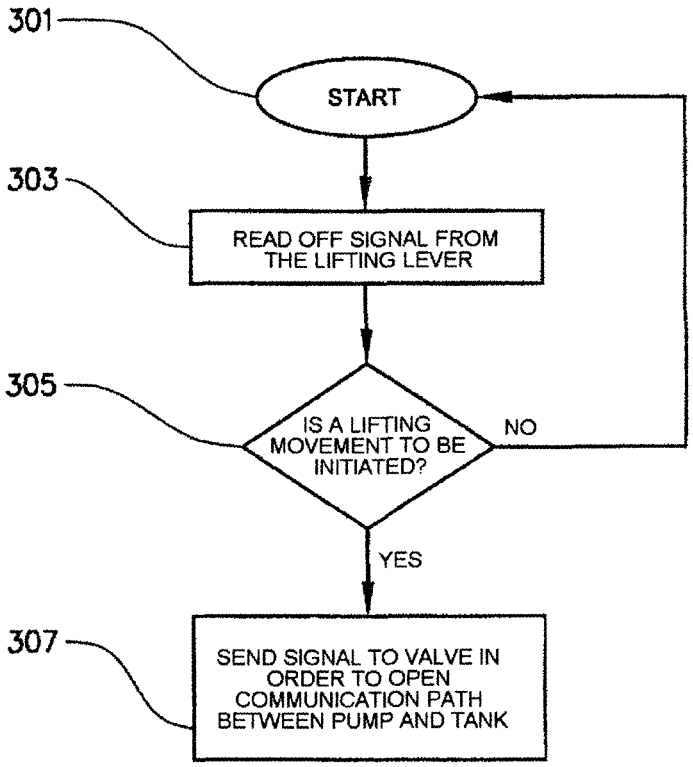
FIG. 3 shows a flow diagram for a lifting of the implement, according to a first example.
Figure 4:
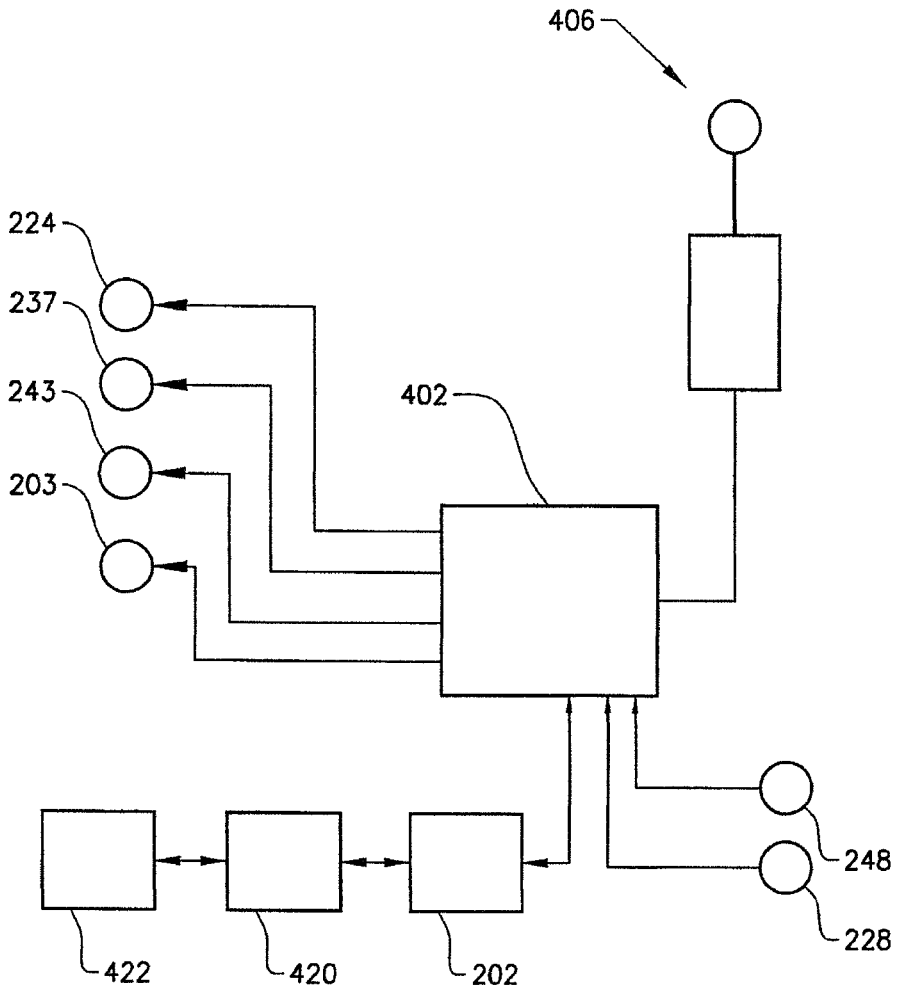
FIG. 4 shows a control system for controlling one or more of the functions of the wheel loader.

FIG. 3 illustrates a flow diagram for the logic circuit in the raising method. The logic circuit commences at the initial block 301. Following this, the control unit continues to block 303, where a signal from a lifting lever 406, see FIG. 4, is read off. In the next block 305, it is determined whether a lifting movement is to be initiated. If the lifting movement is to be initiated, a signal is sent to the valve 203 so that this opens up a communication path between the pump and the tank, see block 307. At the same time, a signal is sent to the electric machine 202 to drive the pump 204.

With a light load, the starting frictions are not so great. According to one example, it is therefore possible to detect a pressure on the piston side of the hydraulic cylinder upon initiation of the lifting movement, to compare the detected pressure with a predetermined value, and for the hydraulic machine to attain the basic speed before lifting takes place, only if the detected pressure exceeds the predetermined value. In other words, the load needs to be a certain weight before any draining is initiated.

In addition or as a variant to the above alternative, a pressure on the piston side of the hydraulic cylinder is detected upon initiation of the lifting movement, and the level of the basic speed of the hydraulic machine is controlled on the basis of the detected pressure. A larger load (that results in a greater pressure) thus means that a greater flow is generated.

In addition, an operating parameter is detected that is indicative of a lifting speed. The detected operating parameter is compared with a predetermined value, and the communication path between the hydraulic machine 204 and the tank 216 is closed off progressively when the detected operating parameter exceeds the predetermined value. For example, the speed of the hydraulic machine is detected via the electric machine 202 for this purpose. According to another example, the position of the implement is detected by means of the sensor 248. The valve 203 is thus closed progressively as the lifting speed increases. According to an alternative, an on/off valve can be utilized instead of the continuously variable valve 203. According to an alternative control method, the on/off valve is kept closed during the lifting movement.

FIG. 4 shows a control system for the lifting function. An operator-controlled element, or control, 406 in the form of a lifting lever is arranged in the cab 114 for manual operation by the driver and is electrically connected to the control unit 402 for controlling the lifting function.

The control unit 402 is normally called a CPU (Central Processing Unit) and comprises a microprocessor and a memory.

The electric machine 202 is electrically connected to the control unit 402 in such a way that it is controlled by the control unit and can provide operating state signals to the control unit.

The control system comprises one or more energy storage means 420 connected to said electric machine 202. The energy storage means 420 can consist of or comprise a battery or a supercapacitor, for example. The energy storage means 420 is adapted to provide the electric machine with energy when the electric machine 202 is to function as a motor and drive its associated pump 204. The electric machine 202 is adapted to charge the energy storage means 420 with energy when the electric machine 202 is driven by its associated pump 204 and functions as a generator.

The wheel loader 101 also comprises a power source 422 in the form of an internal combustion engine, which usually comprises a diesel engine, for propulsion of the vehicle. The diesel engine is connected in a driving manner to the wheels of the vehicle via a drive line (not shown). The diesel engine is moreover connected to the energy storage means 420 via a generator (not shown) for energy transmission.

It is possible to imagine alternative machines/units adapted for generating electric power. According to a first alternative, use is made of a fuel cell which provides the electric machine with energy. According to a second alternative, use is made of a gas turbine with an electric generator for providing the electric machine with energy.

FIG. 4 also shows the other components which are connected to the control unit 402 according to the embodiment of the control system for the lifting function, see FIG. 2, such as the electrically controlled valves 224, 237, 243, 203, the position sensor 248 and the pressure sensor 228.

The invention is not to be regarded as being limited to the illustrative embodiments described above, but a number of further variants and modifications are conceivable within the scope of the following patent claims.

The invention is not limited to the specific hydraulic system that is shown in FIG. 2. The invention can be utilized instead for other types of hydraulic systems, such as a conventional hydraulic system in which the hydraulic pump is driven directly mechanically by the vehicle's propulsion engine (diesel engine) via a shaft and where the movements of the hydraulic cylinder are controlled by means of valves arranged on lines between the pump and the hydraulic cylinder. For example, the hydraulic system can be a load-detecting system.

The position sensor 248 can consist of or comprise a linear sensor for detecting the position of the piston rod, or alternatively can consist of or comprise an angle sensor that detects an angular position of the load arm 106.

The invention claimed is:

1. A control system for a work machine comprising a hydraulic machine and at least one hydraulic cylinder, wherein a first port of the hydraulic machine is connected to the hydraulic cylinder via a first line, a line that connects the first port of the hydraulic machine and a tank, an electric machine arranged to drive the hydraulic machine, control means arranged in the line to drain the first port of the hydraulic machine, and a control unit programmed to detect that a lifting movement of the implement is to be initiated and, after detecting that a lifting movement of the implement is to be initiated, before the lifting movement takes place by supplying fluid to the hydraulic cylinder, control the control means to provide a leakage flow from the hydraulic machine so that a basic speed of the hydraulic machine is attained, wherein the hydraulic machine is connected to a piston side of the hydraulic cylinder via the first line and a piston-rod side of the hydraulic cylinder via a second line, the hydraulic machine has a second port which is connected to the piston-rod side of the hydraulic cylinder via the second line, and the hydraulic machine is arranged to be driven in two different directions, with one direction being associated with a flow out from the first port and the second direction being associated with a flow out from the second port.

2. The control system as claimed in claim 1, wherein the control means comprises an electrically controlled valve.

3. The control system as claimed in claim 1, wherein the control means comprises a continuously variable valve.

4. The control system as claimed in claim 1, wherein the control system comprises a lifting lever for detection that a lifting movement of the implement is to be initiated.

5. The control system as claimed in claim 1, wherein the system comprises a sensor for sensing pressure on the piston side of the hydraulic cylinder.

6. The control system as claimed in claim 1, wherein the hydraulic cylinder is adapted to move an implement in order to perform a work function.

7. The control system as claimed in claim 6, wherein the hydraulic cylinder comprises a lifting cylinder for moving a load arm which is pivotably connected to a vehicle frame, the implement being arranged on the load arm.

8. The control system as claimed in claim 6, wherein the hydraulic cylinder comprises a tilting cylinder for moving the implement, which is pivotably connected to a load arm, which is in turn pivotably connected to a vehicle frame.

* * * * *